US010845138B2

(12) United States Patent
Landis et al.

(10) Patent No.: US 10,845,138 B2
(45) Date of Patent: Nov. 24, 2020

(54) MINI MAGWELL FOR SEMI-AUTOMATIC PISTOLS OF MULTIPLE CALIBERS

(71) Applicant: Samson Manufacturing Corporation, Keene, NH (US)

(72) Inventors: Tanner Landis, Keene, NH (US); Jonathan Bernashe, Sunderland, MA (US)

(73) Assignee: Samson Manufacturing Corporation, Keene, NH (US)

( * ) Notice: Subject to any disclaimer, the term of this patent is extended or adjusted under 35 U.S.C. 154(b) by 0 days.

(21) Appl. No.: 16/255,247

(22) Filed: Jan. 23, 2019

(65) Prior Publication Data

US 2020/0025472 A1 Jan. 23, 2020

Related U.S. Application Data

(60) Provisional application No. 62/621,128, filed on Jan. 24, 2018.

(51) Int. Cl.

| | |
|---|---|
| ***F41A 3/66*** | (2006.01) |
| ***F41A 9/61*** | (2006.01) |
| ***F41C 23/10*** | (2006.01) |

(52) U.S. Cl.

CPC ..... *F41A 3/66* (2013.01); *F41A 9/61* (2013.01); *F41C 23/10* (2013.01)

(58) Field of Classification Search

CPC ..... F41A 3/66; F41A 9/61; F41A 9/65; F41A 11/02; F41A 17/38; F41C 23/10

See application file for complete search history.

(56) References Cited

U.S. PATENT DOCUMENTS

| | | | | |
|---|---|---|---|---|
| 4,139,958 | A * | 2/1979 | Foote | F41A 9/71 42/49.02 |
| 6,070,352 | A * | 6/2000 | Daigle | F41A 11/02 42/49.02 |
| 7,568,302 | B1 * | 8/2009 | Bubits | F41A 17/56 42/70.01 |
| 9,927,193 | B2 * | 3/2018 | Beasley | F41A 9/71 |
| 10,066,885 | B2 * | 9/2018 | Chen | F41A 35/00 |
| 10,101,109 | B2 * | 10/2018 | Caudle | F41A 11/02 |
| 10,260,827 | B2 * | 4/2019 | Mock | F41A 3/66 |
| 10,488,142 | B2 * | 11/2019 | Jacobson | F41A 23/18 |
| 2019/0212085 | A1 * | 7/2019 | Wilkinson | F41A 3/66 |
| 2019/0226779 | A1 * | 7/2019 | DiChario | F41A 17/38 |

* cited by examiner

*Primary Examiner* — Joshua T Semick

(74) *Attorney, Agent, or Firm* — Burns & Levinson LLP; Bruce D. Jobse

(57) ABSTRACT

An apparatus for extending the magazine well of a firearm has extender body dimensioned to receive a firearm magazine and an expandable securing mechanism coupled to the extender body and selectively expandable against the internal cavity adjacent the magazine well on most firearms. Movement of a driving element in the expandable securing mechanism causes an expandable member thereof to transition from a first unexpanded configuration to a second expanded configuration for frictionally engaging interior surfaces of the internal cavity, and vice versa.

18 Claims, 2 Drawing Sheets

MINI MAGWELL FOR SEMI-AUTOMATIC PISTOLS OF MULTIPLE CALIBERS

FIELD OF THE INVENTION

The disclosure relates to the field of firearms and, more specifically, to an extended grip surface semi-permanently fixable to the pistol grip that enables proper ejection and reloading of magazines into the firearm.

BACKGROUND OF THE INVENTION

In a modern firearm, reloading is often accomplished by an ammunition magazine ("magazine"), which stores a series of bullets that are continuously fed into the firearm chamber for firing. Some firearms implement detachable magazines, which, after being emptied, drop out of the magazine well and are replaced with another loaded magazine. In combat, police work, or other situations with potentially heavy crossfire, a user usually carries several fully loaded detached magazines to facilitate reloading of a firearm during an engagement. The time necessary to eject a spent magazine and insert a fresh magazine with proper orientation into the firearm may be critical in a combat situation. The foregoing activities may distract a shooter, causing them to take their eyes off a target, and/or re-aim their firearm once the magazine is properly inserted.

A recent trend in firearm designs, particularly with pistols, is for smaller, more compact weapons. Some firearms, such as the Smith & Wesson M&P® 9 Shield, have a compact, easily concealed size. As such, a user's hand may sometimes extend beyond the end of the pistol grip at least partially obstructing a spent magazine from dropping from the magazine well. In addition, pistols with shorter grips have shorter magazine wells and cannot handle extended size magazines which are capable of retaining multiple additional rounds.

A number of commercially available aftermarket accessories are available in the form of a flanged shaped extended grip apparatus which may be permanently or semi-permanently securable about the magazine well opening at the end of a pistol grip at the point where a magazine is inserted into a pistol handle. Such devices often include tapered interior surfaces which are intended to guide the end of the magazine into the proper orientation as it is inserted into a pistol handgrip and add additional length to the pistol grip allowing the spent magazines to fall freely without the shooter having to reorient their hand, as well as allowing for some extended magazines to be used with a pistol having a shorter handgrip and correspondingly shorter magazine well depth. Unfortunately, such accessories often require the skills of a gunsmith for installation and permanently alter the configuration of the firearm once installed. In addition, such accessories typically are not compatible with firearms, particularly pistols, of multiple different calibers and designs.

Accordingly, a need exists for a magazine well accessory which is simple in design and which may be rapidly attached or detached to a firearm, particularly a pistol, without the help of a gunsmith.

A further need exists for a magazine well accessory which is compatible with firearms, particularly pistols, of multiple different calibers and designs without requiring separate or additional different attachment pieces or assemblies.

A further need exists for a magazine well accessory which allows magazines to drop freely.

A further need exists for a magazine well accessory which does not permanently modify a pistol.

A further need exists for a magazine well accessory which has interior beveled walls which facilitates proper orientation of a magazine into a magazine well and reduces magazine reload times.

A further need exists for a magazine well accessory which provides extended finger grooves with a full grip for increased control of pistol.

SUMMARY OF THE INVENTION

Disclosed is a magazine well extender apparatus that provides an extended grip surface semi-permanently fixable to a pistol grip. The magazine well extender apparatus comprises a body having a profile shaped to facilitate magazine insertion into the handgrip cavity of a firearm and an expandable member which is disposable within the cavity of the firearm pistol grip. Movement of a tensioning screw causes the expandable member to expand outward against the walls of the handgrip cavity thereby securing the extender apparatus to the pistol grip. The extender apparatus provides an extended grip surface semi-permanently fixable to a pistol grip and works with semi-automatic pistol factory components, including the factory magazines, without the use of proprietary components or modifications to the host weapon.

According to one aspect of the disclosure, a magazine well extender apparatus for use with a firearm having an internal cavity proximate a magazine well of the firearm comprises: an extender body defining an aperture dimensioned to receive a firearm magazine; and an expandable securing mechanism coupled to the extender body and selectively expandable against the interior cavity. In one embodiment, the expandable securing mechanism comprises an expandable member having a first unexpanded configuration and a second expanded configuration, and a driving element movably coupled relative to the expandable member. In one embodiment, movement of the driving element relative to the expandable member is used to change the expandable member from a first unexpanded configuration to a second expanded configuration or vice versa.

According to yet another aspect of the disclosure, a magazine well extender apparatus for use with a firearm having an internal cavity proximate a magazine well of the firearm comprises: an extender body defining an aperture dimensioned to receive a firearm magazine; and a securing mechanism coupled to the extender body and selectively expandable against the internal cavity. In one embodiment, the securing mechanism comprises: an expandable member, and a driving element movably coupled relative to the expandable member, wherein movement of the driving element relative to the expandable member causes the expandable member to transition from one of a first unexpanded configuration and a second expanded configuration to the other of the first unexpanded configuration and the second expanded configuration.

According to yet another aspect of the disclosure, a method for securing a magazine well extender apparatus to a firearm having an internal cavity proximate the magazine well of the firearm, the method comprises: A) providing a magazine well extender apparatus having an extender body, an expandable member having a first unexpanded configuration and a second expanded configuration, and a driving element movably coupled relative to the expandable member; B) disposing the expandable member within the internal cavity; and C) moving the driving element relative to the expandable member to cause the expandable member to transition from the first unexpanded configuration to the second expanded configuration.

BRIEF DESCRIPTION OF THE DRAWINGS

The accompanying drawings, which are incorporated into and form a part of the instant specification, illustrate several aspects and embodiments of the subject technology and, together with the description herein, serve to explain the principles of the subject technology. The drawings are provided for the purpose of illustrating embodiments of the subject technology and are not to be construed as limiting the subject technology. In the drawings.

DETAILED DESCRIPTION

Figure 1:
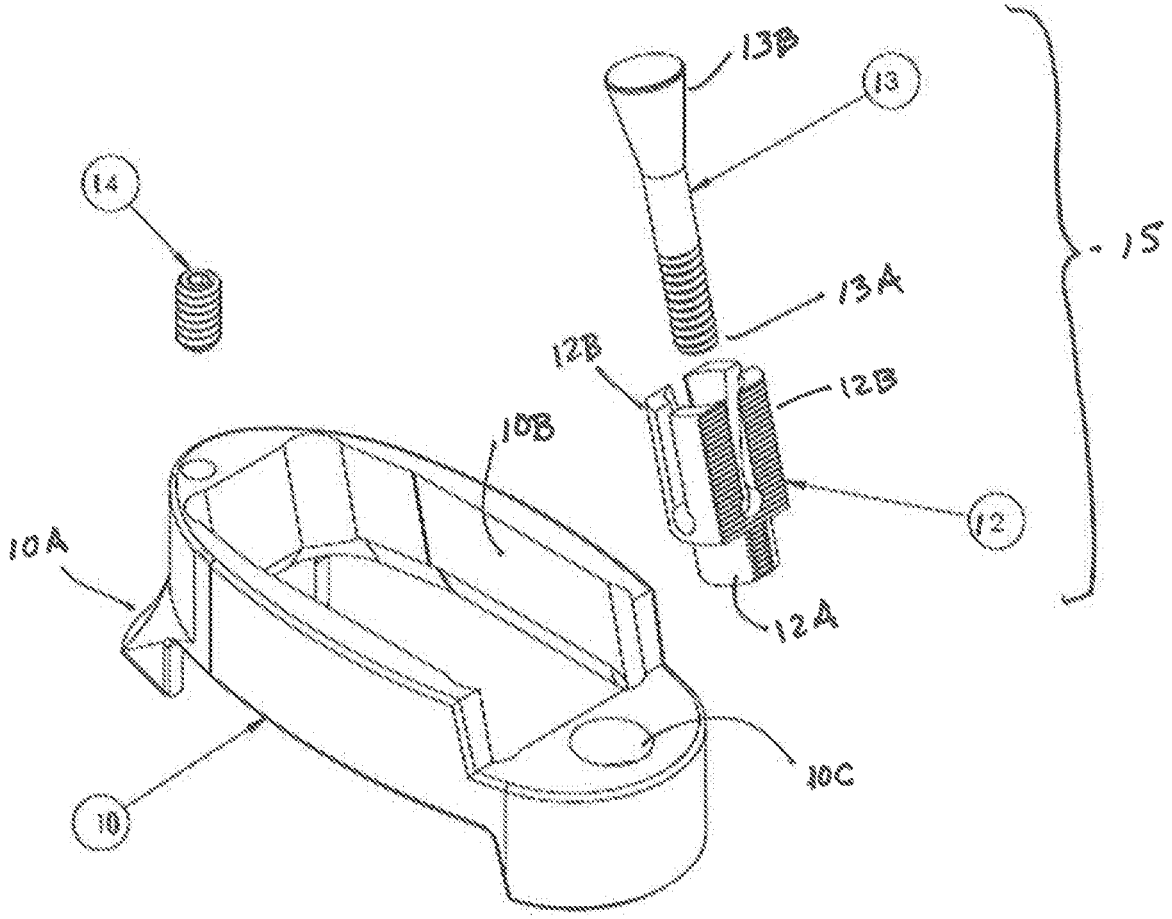
FIG. 1 illustrates conceptually an exploded isometric view of a magazine well extender apparatus in accordance with the disclosure.

The advantages, and other features of the apparatus and methods disclosed herein, will become more readily apparent to those having ordinary skill in the art from the following detailed description of embodiments taken in conjunction with the drawings which set forth representative embodiments of the present invention. Like reference numerals are used herein to denote like parts. Further, words denoting orientation such as "top", "bottom", "side", "lower" and "upper", and the like, are merely used to help describe the location of components with respect to one another. No words denoting orientation are used to describe an absolute orientation, i.e., where an "upper" part must always be on top.

FIG. 1 illustrates conceptually an exploded isometric view of a magazine well extender apparatus or device 5 in accordance with the disclosure. Device 5 comprises an extender body 10, and expandable securing mechanism 15, and an optional guide element 14. The expandable securing mechanism 15 is selectively expandable and contractible within an existing hollow cavity in the handgrip of the pistol next to the magazine well for removably securing body 10 to the end of the pistol grip, as explained in greater detail herein.

In embodiments, body 10 has a generally ovoid toroidal shape with an exterior profile which mimics the shape and dimensions of the end of the magazine well to which it will be attached. In the illustrated embodiment, a flared angle front portion 10A of body 10 provides an extended finger groove that allows for a fuller grip and increased control of the pistol for the shooter. A tapered aperture 10B extends through body 10. The aperture is defined by an internal chamfered surface which provides a larger opening for ease of magazine insertion into the pistol frame. The aperture dimensions transition from a larger dimension, sized according to the dimensions of the magazine which will be inserted into the magazine well, to a smaller dimension sized according to the dimensions of the magazine well of the pistol to which the body 10 will be affixed.

In embodiments, expandable securing mechanism 15 comprises an expandable member 12 and a driving element 13. The position of driving element 13 is used to activate and/or deactivate expandable member 12, causing the expandable member to at least partially fill and frictionally engage the walls of the cavity within the pistol grip, thereby securing body 10 to the end of the pistol grip. In the illustrated embodiment, driving element 13 comprises a screw having a threaded first end 13A having a first diameter and a second end 13B having a larger second diameter. The transition in diameter between the ends may occur in a gradual, tapered manner as illustrated. The first end 13A of driving element 13 has a feature formed at the end thereof which enables driving element 13 to be repositioned relative to body 10 and expandable member 12. In one embodiment, such feature comprises any of a hexagonal socket, Phillips head recess, or a blade-type recess formed in the end thereof.

Expandable member 12, in the illustrated embodiment, may be implemented with a collet—like structure comprising a segmented band or sleeve having a body member with an aperture extending therethrough and which defines a plurality of flexible structures extending outward therefrom. The extent to which the structures expand outward is dependent upon the size of driving element 13 disposed within the aperture which extends through the body of expandable member 12. As illustrated, the body of expandable member 12 has a first generally cylindrical end 12A dimensioned to fit within a drive aperture 10C which extends through body 10 of device 5. The second end of the body member comprises a plurality of flexible segments 12B, each segment having a first free end and a second end attached to the body of expandable member 12. The exterior surfaces of the body member first end and the flexible segments may be corrugated, toothed, or textured with features to increase their frictional engagement with any surfaces to which they come into contact, as illustrated. The interior surface of each of the flexible segments 13B may have an arcuate, tapering shape of decreasing diameter from the first free end to the second attached end, such surfaces complementing the shape of the larger diameter second end of driving element 13.

Guide element 14 is affixed to the top surface of body 10 and may be implemented with a cup point set screw threaded into an aperture in body 10. Guide element 14 rests in a corresponding open hole in the end of the pistol grip. For pistols which do not have such an open hole, element 14 may be eliminated.

In practice, driving element 13 is disposed within the aperture of expandable member 12, while the first end 12A is seated within the driving aperture 10C of body 10, as illustrated by the dashed lines in FIG. 1, so that the socket or recess feature at the first end 13A is exposed and accessible through driving aperture 10C which opens to the underside of body 10. The device 5 is then positioned at the open bottom of the pistol grip so that aperture 10B aligns with the magazine well of the pistol and expandable member 12 rests within the hollow cavity in the pistol grip adjacent the magazine well. Rotation of driving element 13 via the threaded screw proximate first end 13A thereof will cause the driving element to be drawn down into expandable member 12, causing the larger diameter tapered surface 13B to co-act with the interior surfaces of flexible segments 12B, forcing the free ends of flexible segments 12B to flex outward and against the surfaces of the interior cavity of the pistol grip securing the expandable member 12 within the cavity and securing the body 10 to the pistol grip end. If the pistol grip includes a hole, guide element 14 may be first aligned with such hole to ensure proper alignment of the body 10 relative to the open end of the pistol.

Figure 2:
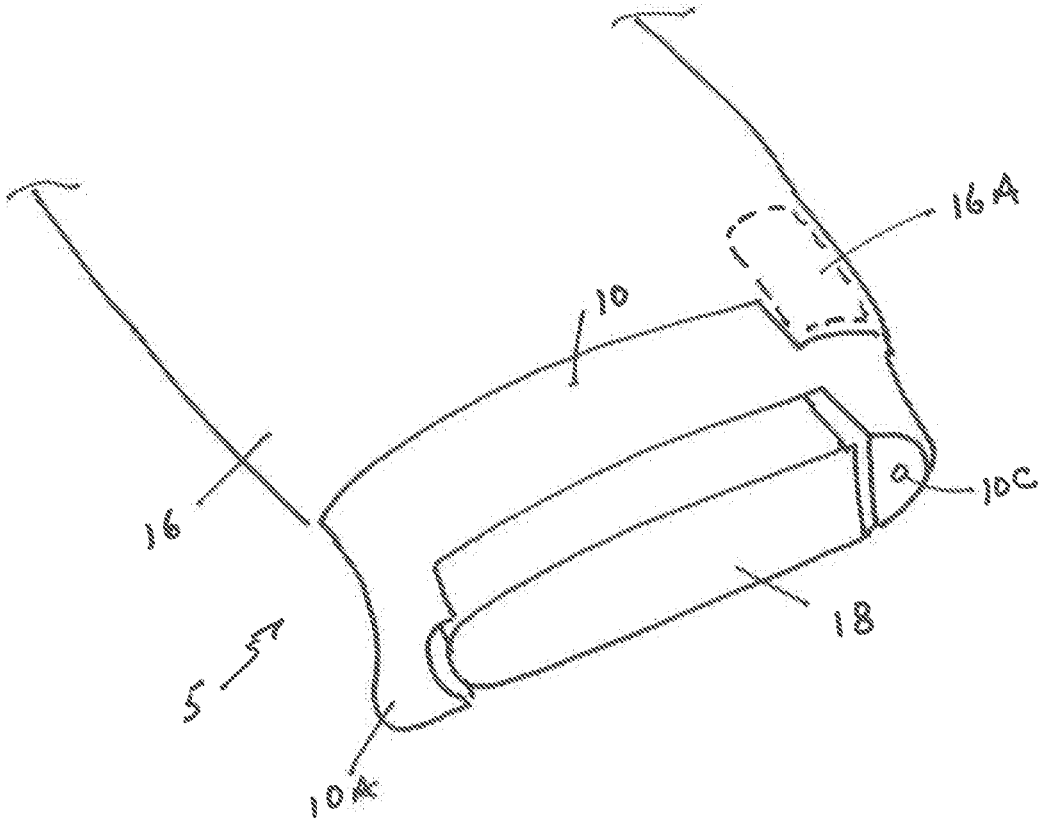
FIG. 2 illustrates conceptually a partial perspective view of the magazine well extender of FIG. 1 secured to a pistol in accordance with the disclosure.

FIG. 2 illustrates conceptually a partial perspective view of the magazine well extender apparatus 5 secured to the end of a pistol handgrip 16 with a magazine 18 extending through the extender apparatus 5 and into the magazine well of pistol handgrip 16. FIG. 2 further illustrates the proximate location of interior cavity 16A within the pistol handgrip 16 where expandable member 12 is disposable for securing the extender apparatus to the pistol handgrip 16.

Although the embodiment described herein utilizes a driving element 13 which is driven downward into expandable member 12, the direction of movement may be reversed, with driving element 13 being driven upward into expandable member 12, if the orientation of expandable member 12 is similarly accommodated.

Further, although the embodiment described herein utilizes a driving element 13 in the form of a screw having a threaded shaft and a larger diameter taper head, other configurations of driving element may be used, including those with smooth shafts or other configurations of an enlarged second end, including beaded, spherical, ovoid, or other in large diameter shapes, which when used in conjunction with complementary interior surfaces on flexible segments 12B are capable of forcing flexible segments 12B into an outward expanded configuration capable of securing body 10 to the end of a pistol grip. In other configurations, the number of flexible segments 12 may vary according to the designer's choice.

The reader will appreciate that the device disclosed herein provides an extended grip surface semi-permanently fixable to a firearm. The magazine well extender apparatus works with semi-automatic pistol factory components including the factory magazines, without the use of proprietary components or modifications to the host weapon and without the need for a gunsmith. Although the illustrative embodiments have been described with reference to a firearm having an interior cavity adjacent the magazine well in a pistol handgrip, the disclosed apparatus and methods are equally applicable to firearms, other than pistols, in which a cavity internal to the firearm exists adjacent to or in proximity of the firearm magazine well.

It is to be understood that the present invention is not limited to the embodiment described above. It will be obvious to those reasonably skilled in the art that modifications to the apparatus and process disclosed herein may occur, including substitution of various component values or nodes of connection, without parting from the true spirit and scope of the disclosure. For example, although the illustrative embodiments have been shown for use with pistols, the apparatus disclosed herein is equally applicable to any firearm that includes a magazine well with an adjacent interior cavity.

What is claimed is:

1. A magazine well extender apparatus for use with a firearm having an internal cavity proximate a magazine well of the firearm, the apparatus comprising: an extender body defining an aperture dimensioned to receive a firearm magazine; and an expandable securing mechanism coupled to the extender body and selectively expandable against the internal cavity of the firearm, the securing mechanism comprising: an expandable member having a body member with an aperture extending therethrough, the expandable member configured to flex outward from the aperture, and a driving element movable within the aperture of the expandable member, wherein the expandable member has a first unexpanded configuration and a second expanded configuration.

2. The apparatus of claim 1 wherein movement of the driving element relative to the expandable member causes the expandable member to transition from one of the first unexpanded configuration and a second expanded configuration to the other of the first unexpanded configuration and the second expanded configuration.

3. The apparatus of claim 1 wherein the driving element has a generally cylindrical shaped body with a first end diameter and a second end diameter larger than the first end diameter.

4. The apparatus of claim 3 wherein the driving element comprises a screw having a threaded exterior proximate a first end thereof and an tapered diameter region proximate the second end thereof.

5. The apparatus of claim 1 wherein the body member further comprises a projection removably couplable with the extender body and a second end comprising a plurality of flexible segments.

6. The apparatus of claim 1 wherein the body member further comprises a plurality of flexible segments extending outward therefrom.

7. The apparatus of claim 6 wherein each of the flexible segments has a first free end and a second end attached to the body member.

8. The apparatus of claim 7 wherein directional movement of driving element relative to the aperture causes one of outward expansion and inward contraction of the flexible segments relative to the body member.

9. The apparatus of claim 5 wherein exterior surfaces of the flexible segments define features to increase frictional engagement with surfaces of the internal cavity.

10. A magazine well extender apparatus for use with a firearm having an internal cavity proximate a magazine well of the firearm, the apparatus comprising:

an extender body defining an aperture dimensioned to receive a firearm magazine; and a securing mechanism coupled to the extender body and selectively expandable against the internal cavity, the securing mechanism comprising:

an expandable member having a body member with an aperture extending therethrough, the expandable member configured to flex outward from the aperture, and a driving element movable within the aperture of the expandable member.

11. The apparatus of claim 10 wherein movement of the driving element relative to the expandable member causes the expandable member to transition from one of a first unexpanded configuration and a second expanded configuration to the other of the first unexpanded configuration and the second expanded configuration.

12. The apparatus of claim 10 wherein the driving element has a generally cylindrical shaped body with a first end diameter and a second end diameter larger than the first end diameter.

13. The apparatus of claim 12 wherein the driving element comprises a screw having a threaded exterior proximate a first end thereof and a tapered diameter region proximate the second end thereof.

14. The apparatus of claim 10 wherein the body member further comprises a plurality of flexible segments extending outward therefrom.

15. The apparatus of claim 14 wherein each of flexible segments has a first free end and a second end attached to the body member.

16. The apparatus of claim 14 wherein directional movement of the driving element relative to the aperture causes one of outward expansion and inward contraction of the flexible segments relative to the body member.

17. The apparatus of claim 14 wherein exterior surfaces of the flexible segments define features to increase frictional engagement with surfaces of the internal cavity.

18. A method for securing a magazine well extender apparatus to a firearm having an internal cavity proximate the magazine well, the method comprising:

A) providing a magazine well extender apparatus having an extender body, an expandable member having a body member with an aperture extending therethrough, and a driving element movable within the aperture of the expandable member to cause the expandable member to flex outward from the aperture;

B) disposing the expandable member within the internal cavity of the firearm; and C) moving the driving element relative to the expandable member to cause the expandable member to transition from a first unexpanded configuration to a second expanded configuration.

* * * * *